United States Patent [19]

O'Brien, II

[11] Patent Number: 4,839,939

[45] Date of Patent: Jun. 20, 1989

[54] SECURITY HINGE WITH IMPROVED STRUCTURAL INTEGRITY WITH THE ELECTRICAL WIRES LOCATED ALONG THE PIVOT AXIS OF THE KNUCKLES

[76] Inventor: James A. O'Brien, II, 1331 W. Outer 21 Rd.-Lower Level, P.O. Box 405, Arnold, Mo. 63010-0405

[21] Appl. No.: 172,390

[22] Filed: Mar. 24, 1988

[51] Int. Cl.[4] ..... E05D 3/06

[52] U.S. Cl. ..... 16/223; 439/31

[58] Field of Search ..... 16/223, 273, 386; 439/31, 165

[56] References Cited

U.S. PATENT DOCUMENTS

| | | | |
|---|---|---|---|
| 612,192 | 10/1898 | Chandler | 439/31 |
| 3,857,625 | 12/1974 | Crane et al. | 16/223 X |
| 4,116,514 | 9/1978 | Lawrence | 16/223 X |
| 4,168,409 | 9/1979 | McNinch | 439/31 X |
| 4,412,711 | 11/1983 | Suska | 439/31 |

*Primary Examiner*—Fred A. Silverberg
*Attorney, Agent, or Firm*—Henry W. Cummings

[57] ABSTRACT

An improved security hinge is provided in which security control wires pass through only one or two knuckles of a hinge whereby improved structural integrity of the hinge is achieved. Slots are cut through the body of the hinge which extend only part way through the thickness of the body of the hinge, and which are located between fastener openings whereby the integrity of the body of the hinge is not impaired. Furthermore, the security control wires extend through only one or two knuckles of the hinge, leaving one or more knuckles undisturbed, whereby the structural integrity of the knuckle portion of the hinge is not impaired. In an alternative embodiment, a hollow sleeve is formed from hardened steel through which the security control wires pass, whereby even greater structural integrity is achieved.

12 Claims, 3 Drawing Sheets

FIG. 1.
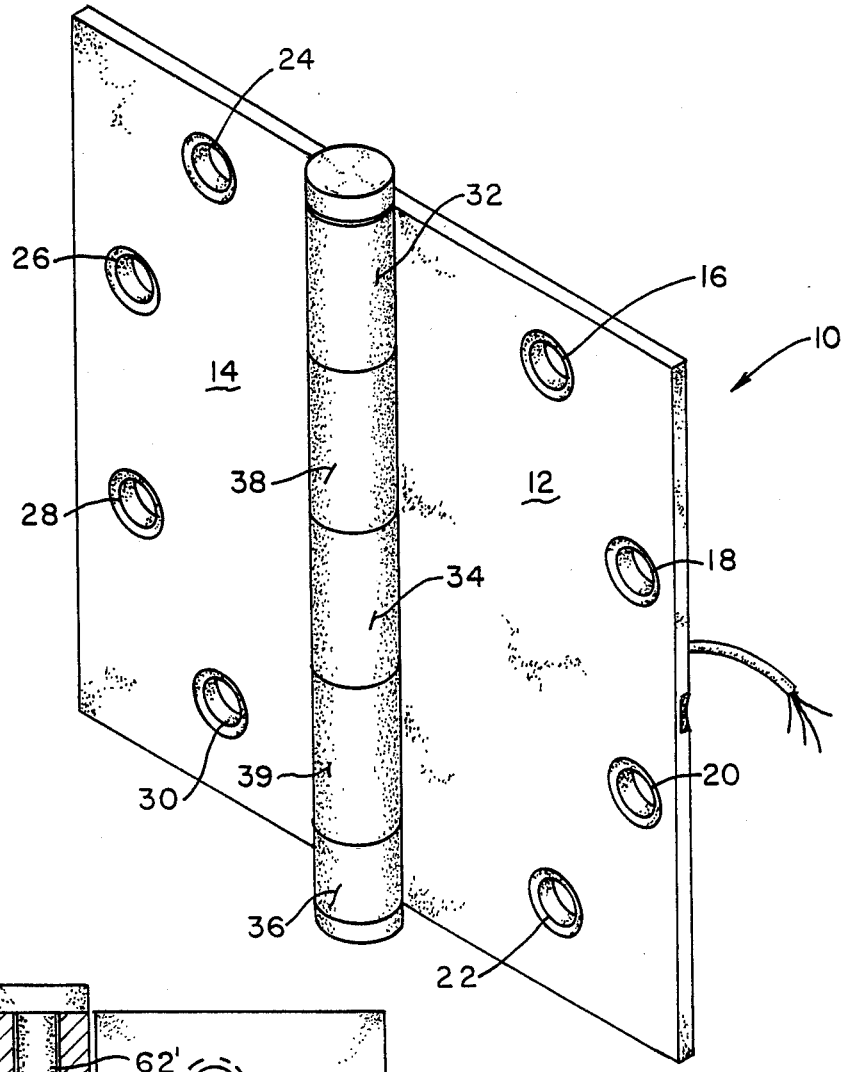
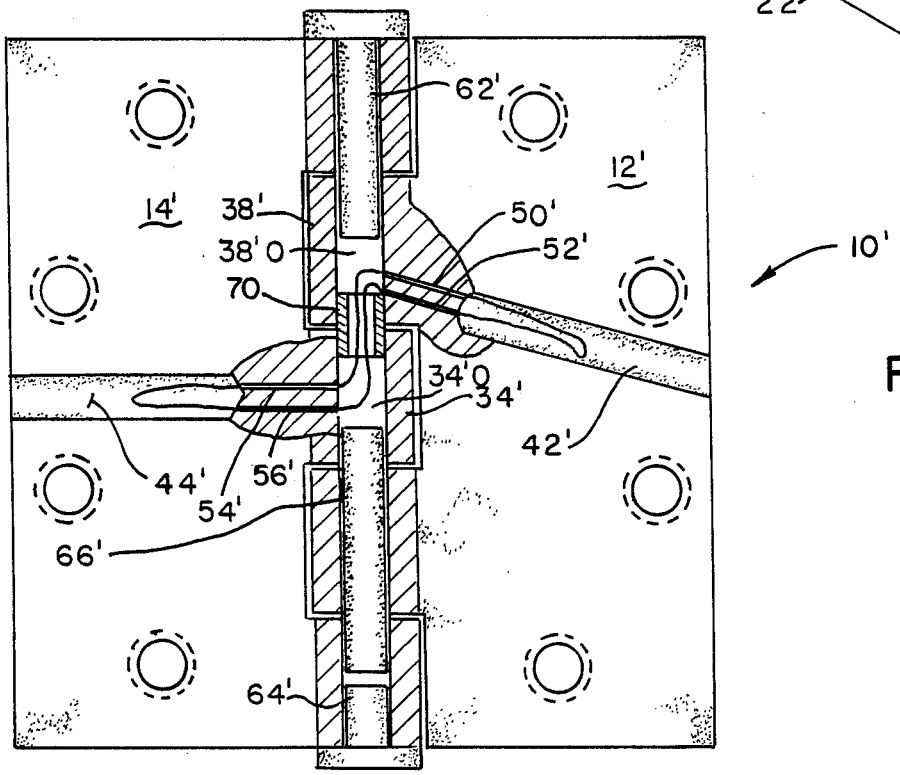
FIG. 4.

SECURITY HINGE WITH IMPROVED STRUCTURAL INTEGRITY WITH THE ELECTRICAL WIRES LOCATED ALONG THE PIVOT AXIS OF THE KNUCKLES

BACKGROUND OF THE INVENTION

In U.S. Pat. No. 4,116,514 a security hinge is disclosed in which the security control wires extend through at least threeknuckles of the hinge.

In this design, the structural integrity of the hinge is comprised because of the weakened knuckle structure due to the wires passing through all these knuckles.

SUMMARY OF THE INVENTION

A. Objects of the Invention

One object of the invention is to provide a security hinge in which the structural integrity of the hinge is improved.

Another object of the invention is to provide a hinge design in which the security control wires pass through only one or two knuckles of the hinge.

Another object is to provide an improved hinge design in which the knuckles through which the security wires pass are provided with improved structural integrity.

THE DRAWINGS

FIG. 1 is a perspective view of the improved security hinge of the present invention.

FIG. 4 is a side elevation view of another embodiment of the present invention illustrating the use of a hardened hollow sleeve to support the area in the hinge knuckle where the control wires pass through the knuckle.

DESCRIPTION OF PREFERRED EMBODIMENTS

Figure 3:
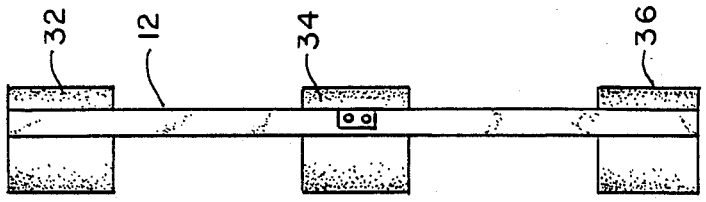
FIG. 3 is an end elevation view of FIG. 2 looking in the direction of the arrows along the line 3—3 in FIG. 2.

U.S. Pat. No. 4,116,514 issued Sept. 26, 1978 entitled SECURITY HINGE may be referred to for background concerning the hinge construction of the present invention. This patent is hereby incorporated into the present application by this reference.

The present invention constitutes an improvement over this patent. In the drawings, a security hinge 10 comprises a pair of leaves 12 and 14. Each of the leaves include a plurality of fastener openings 16, 18, 20, 22, 24, 26, 28 and 30. These fastener openings allow the hinge to be attached to a door or window to allow a fixed member and a pivoted member to move to the fixed member.

In the embodiment illustrated, leaf 12 includes three knuckles 32, 34 and 36. Leaf 14 includes two knuckles 38 and 39.

In accordance with the present invention in order to provide the leaves with the provision of security control wires passing therethrough, slot means 40 are provided in the leaves 12 and 14. The slot means 40 includes a first slot 42 in leaf 12 and a second slot 44 in leaf 14. The slots 42 and 44 are preferably drilled to a depth less than the thickness of the respective leaf bodies 12 and 14. For example, if leaf members 12 and 14 are one eighth of an inch thick, slots 42 and 44 are conveniently drilled to about 0.100 inches deep and may have a transverse extent of about 0.125 inches.

Slot 42 is located midway between the centers of fastener openings 18 and 20. Slot 44 is inclined with respect to the horizontal and is located sufficiently far from fastener openings 26 and 28 to avoid weakening of the leaf body in this area. Preferably slot 44 is at least 0.01 inches from the countersink of the fastener openings 26 and 28.

Each of the slots 42 and 44 preferably extend at least half the transverse distance of the respective leaves 12 and 14. In order for the control wires to pass through the hinge each of slots 42, 44 is provide with a pair of openings respectively 50, 52, 54 and 56. These are drilled openings which extend from the end of the slots 42 and 44 into the respective opneings 340 and 380 of the knuckles 34 and 38. These drilled openings may vary in size according to the cross section of the respective leaves 12 and 14; conveniently they may be 0.050 to 0.080 inches in diameter. A pair of control wires pass through slot 42 and one each into respective openings 50 and 52 and then into the opening 340 in knuckle 34. The wires extend upwardly into knuckles 38 through knuckle opening 380 and the pass into respective drill openings 54 and 56 in leaf 14. The wires then extend outwardly through slot 44 to the outside of the hinge.

It will be noted that with this construction only two knuckles, 34 and 38, of the five knuckles 32, 34, 36, 38, and 39 are utilized in control wire passage through the hinge.

In contrast, in U.S. Pat. No. 4,116,514 in FIG. 6 thereof, it is seen that the control wires pass through three bottom knuckles and part of the fourth. Thus, the structural integrity of the hinge of the present invention is improved over that in the '514 patent in that only two knuckles are utilized to carry the control wires to the hinge.

To complete the assembly, pin means 60 are provided to hold the knuckle assembly together. This includes a head pin 62 which extends through knuckle 32 and a toat pin 64 which extends through knuckles 36 and 39. If desired a pin 66 may also be provided of diameter less than the openings 380 and 340 whereby there is sufficient area available in openings 380 and 340 for the control wires to pass through.

Figure 2:
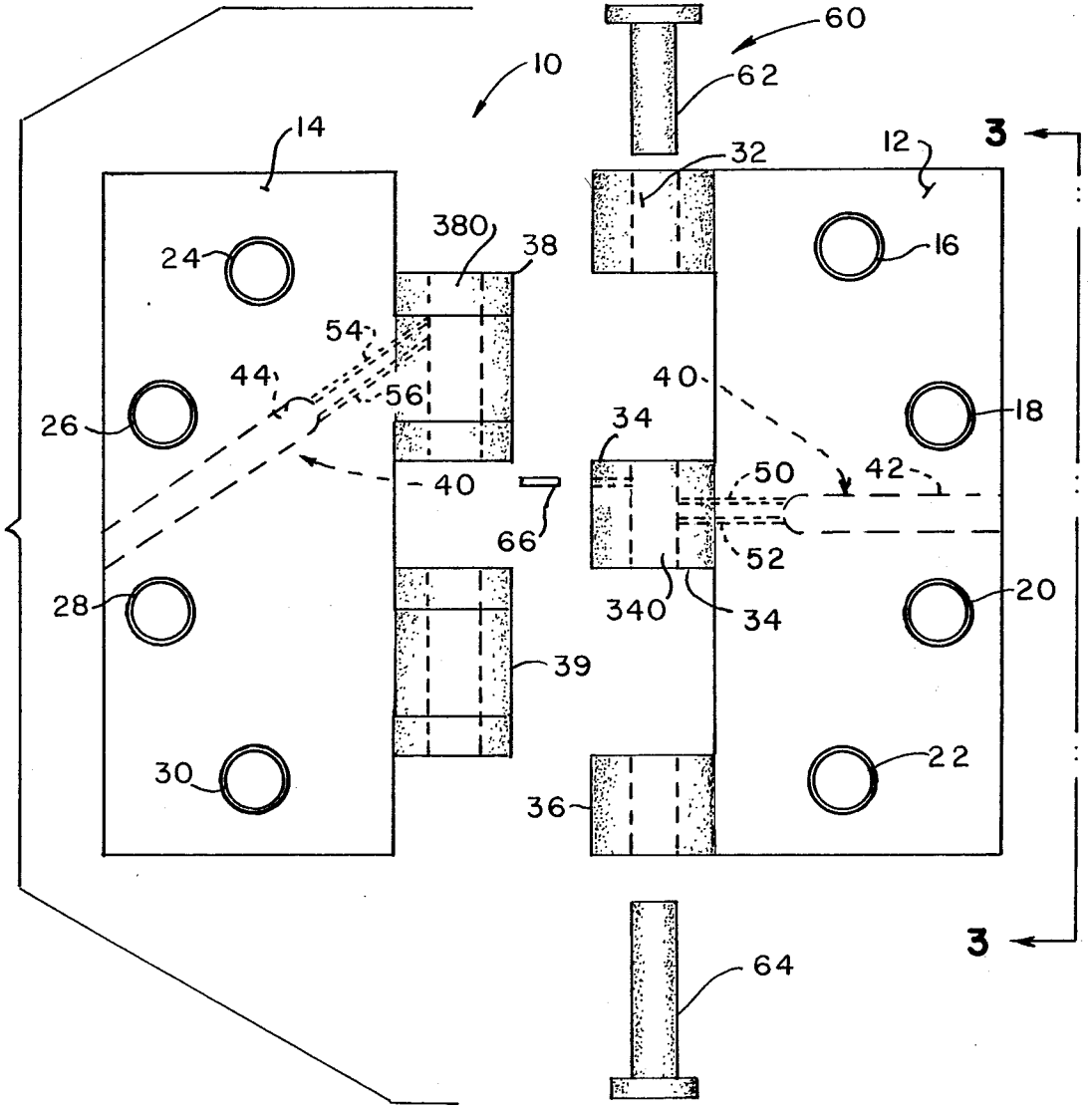
FIG. 2 is an exploded view of the improved security hinge of the present invention.

Another embodiment of the present invention is illustrated in FIG. 4. This embodiment of the invention is a very similar in most respects to the embodiment illustrated in FIGS. 1–3 of the drawings. Corresponding numerals in FIG. 4 have prime numbers which correspond to the similar elements in FIGS. 1–3. Briefly, a security hinge $10^1$ includes a pair of leaves $12^1$ and $14^1$. Leaf $12^1$ includes a security wire slot $42^1$ and leaf $14^1$ includes a security wire slot $44^1$. In addition, leaf 12 includes security wire drilled openings $50^1$ and $52^1$ and leaf 14 includes drilled security wire openings $54^1$ and $56^1$.

The embodiment shown in FIG. 4 includes a hardened steel sleeve indicated at 70 which is hollow and which extends between knuckles $38^1$ and $34^1$. This sleeve has an outside diameter which is commensurate with the inside diameter of the knuckles 38'0 and 34'0. The inside diameter of the hardened sleeve 700 is such that the security controlled wires can readily pass there through. As an example the inside diameter may be about 0.375 inches. The head in $62^1$, the toat pin $64^1$ and the pin $66^1$ hold the hardened sleeve in place.

The hardened sleeve may be made of known heat-treated steel alloys for example 4140 or 4340 steel. Other appropriate hardened steel alloys will be apparent to metallurgists familiar with this application.

The use of the hardened steel sleeve has the advantage that even the knuckles with which the security wires pass are no longer weakened by the wires passing there through. The structural integrity which is reduced by the wires passing through the knuckles is more than compensated for by the hardened steel sleeve extending between the knuckle $34^1$ and $38^1$ through which the security wires pass. Thus a construction is achieved with the embodiment shown in FIG. 4 where the structural integrity of the hinge is equal to or greater than the structural integrity of a hinge note having security wires passing through there.

Figure 5:
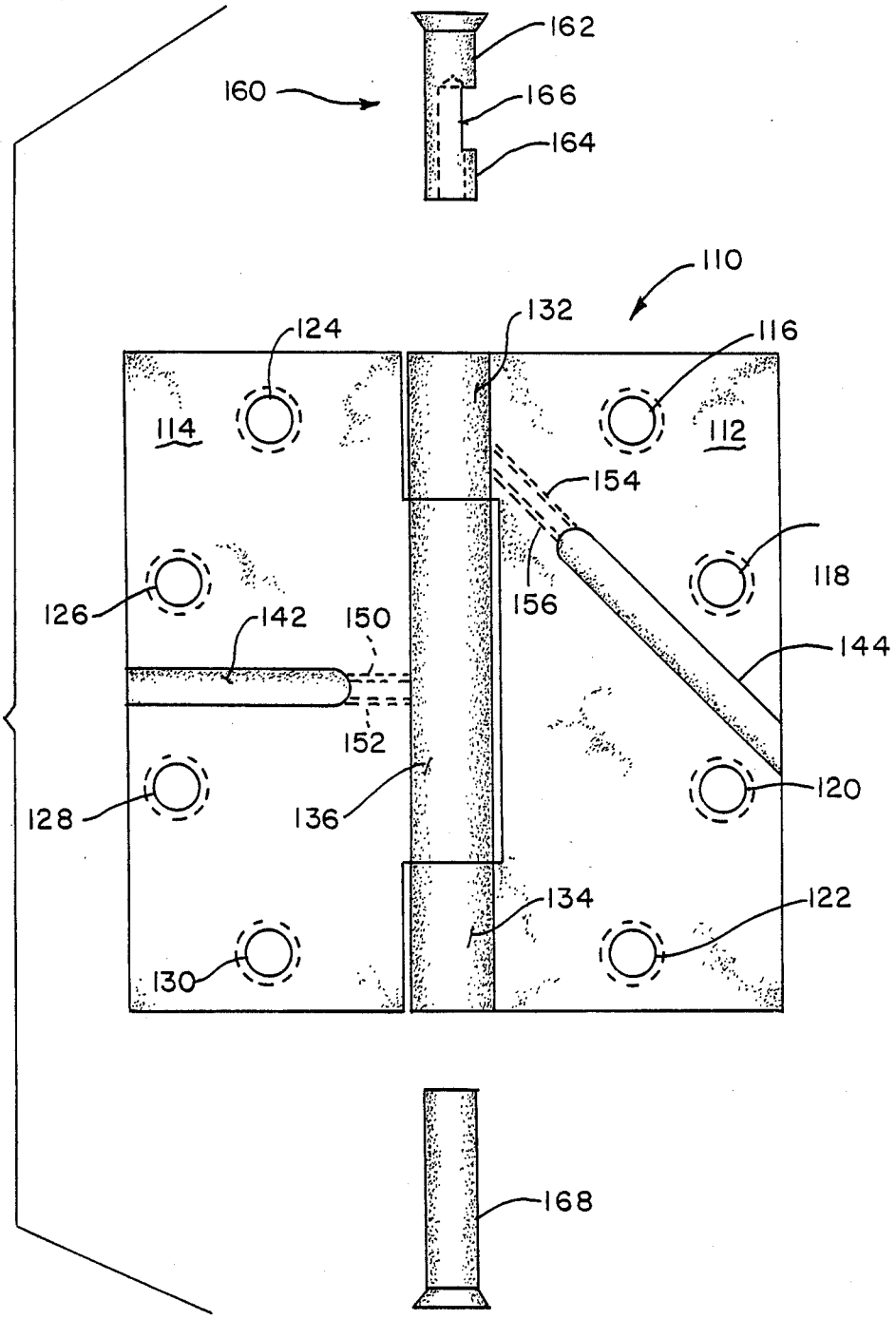
FIG. 5 is an exploded side elevation view of a three knuckle embodiment of the invention.

A three knuckle embodiment of the present invention is illustrated in FIG. 5. In this embodiment a security hinge (110) includes a pair of leaves 112 and 114. The leaves include respectively openings 116, 118, 120 and 122; and 124, 126, 128 and 130. However, in this embodiment leaf 112 includes only 2 knuckles 132 and 134. Leaf 114 includes a third middle knuckle 136.

In this embodiment Leaf 114 includes the transverse slot 42 and Leaf 112 includes the inclined slot 144. Smaller drilled openings 150 and 152 provide fluid communication between the larger drilled opening or slot 142 and the hollow knuckle 136. Leaf 112 includes smaller drilled openings 154 and 156 which terminate within knuckle 132.

It will be apparent that in a manner similar to the previous embodiment, electrical wires extend through slot 142 through space drilled openings 150 and 152 and into knuckle 136. In knuckle 136 the wires extend vertically into knuckle 132, and laterally where they then extend into drilled openings 154 and 156 and then into slot 144.

Pin means 160 includes a slot 166 and a bottom 164 to allow the presence of the electrical wires within the knuckle 132. Formed slot 166 in the pin 162 aligns with the inner end portion of drilled openings 154 and 156.

A bottom pin 168 extends into knuckle 134 and partially into knuckle 136.

As was the case with the previous embodiments a hollow sleeve may also be utilized in the embodiment shown in FIG. 5 as is illustrated in FIG. 4, extending between knuckles 132 and 136. The most convenient was of doing this is to provide that the pin member 162 is a hardened steel member.

What is claimed is:

1. A security hinge having electrical control wires passing axially in a completely uncoiled manner-- has been inserted; there through comprising a pair of cooperating leaves having fastener openings adapted to enable the attachment of the respective leaves to a fixed member and a movable member; each of said leaves including knuckle means adapted to align and co-engage to receive pin means to hold the knuckle means in vertical alignment; said knuckle means comprising at least two knuckles; each of the knuckle means including an aligned vertical axis and having aligned pin openings extending along said axis receiving the uncoiled electrical wires and the pin means to retain the assembly in place; each of said leaves including slot means extending generally transversely through the leaf and being spaced from said openings sufficiently to avoid reducing the structural integrity of the body of said leaves; each of said slots being in fluid communication with at least one opening extending from the end of the slot into an axial opening located within one of said knuckle means, the control wires extend through the slots in each of the leaves and through the openings in each of leaves and through the aligned openings along said vertical axis in the knuckles within said hinge, and said wires pass uncoiled through no more than two said knuckles; and the pin means including upper and lower pin members including a first upper pin member extending through the uppermost knuckles and a second lower pin member extending through the bottomost knuckles.

2. An improved security hinge according to claim 1 wherein a pair of openings extend from each of said slots into the axial opening in each of respective knuckles.

3. An improved security hinge according to claim 2 wherein the slots in said leaves do not extend throughout the full thickness of the leaves.

4. An improved security hinge according to claim 1 wherein said leaves includes three knuckles and the other of said at least two knuckles comprises five knuckles, one of said leaves includes two knuckles and wherein in the leaf including three knuckles the slot extends perpendicular to the axis of the openings of the knuckle and wherein in the leaf containing two knuckles the slot extends diagonally toward the axis of the openings of said knuckles.

5. An improved security pin according to claim 1 wherein said at least two knuckles comprising three knuckles, one leaf is provided with two knuckles and the other leaf is provided with one knuckle and wherein the electrical wires extend through at least one knuckle in each of the leaves and wherein one knuckle is free from the passage of wires there through.

6. A security hinge according to claim 5 wherein a least one pin is in communication with at least one of knuckles through which the wires pass and wherein a slot is formed in the pin to accommodate the wire's passage through the knuckle.

7. A security hinge according to claim 6 wherein in addition to the opening to accommodate the wires, a slot is formed in the pin located generally in the area wherein the openings in the leaf intercept the knuckle.

8. An improved security hinge according to claim 1 wherein a hardened hollow sleeve is located between the knuckles through which the wires pass.

9. A five knuckle security hinge having electrical control wires passing axially in a completely uncoiled manner there through comprising: a pair of cooperating leaves having fastener openings adapted to enable the attachment of the respective leaves to a fixed member and a movable member; one of said leaves including three knuckles adapted to align and co-engage two knuckles of the other leaf alternately in vertical alignment; each of the knuckles including an aligned vertical axis and aligned pin openings extending along said axis receiving the uncoiled wires and the pin means to retain the assembly in place; each of said leaves including slot means extending generally transversely through the leaf and being spaced from said openings sufficiently to avoid reducing the structural integraty of the body of the said leaves; each of said slots being in fluid communication with at least one opening extending from the end of the slot into an axial opening located within one of said knuckles, the control wires extend through the slots in each of the leaves and through the openings in each of leaves and through the aligned openings along said vertical axis in the knuckles within said hinge, and said wires pass uncoiled through no more than two knuckles; and the pin means including upper and lower pin members including a first upper pin member extending through the uppermost knuckle and a second lower pin member extending through the bottommost knuckles.

10. An improved security hinge according to claim 9 wherein a pair of openings extend from each of said slots into the axial opening in each of respective knuckles.

11. An improved security hinge according to claim 10 wherein in the leaf including three knuckles, the slot extends perpendicular to the axis of the openings of the knuckle and wherein, in the leaf containing two knuckles, the slot extends diagonally toward the axis of the openings of said knuckles.

12. An improved security hinge according to claim 11 wherein the slots in said leaves do not extend throughout the full thickness of the leaves.

* * * * *